United States Patent [19]

Gehrke et al.

[11] Patent Number: 4,635,399

[45] Date of Patent: Jan. 13, 1987

[54] DOOR JAMB SUPPORT

[76] Inventors: David E. Gehrke, 3202 N. 54th St., Milwaukee, Wis. 53216; Hans Ewald, N55W14332 Carol Dr., Menomonee Falls, Wis. 53051

[21] Appl. No.: 718,484

[22] Filed: Apr. 1, 1985

[51] Int. Cl.[4] ..... E06B 3/30; E04G 23/02

[52] U.S. Cl. ..... 49/460; 49/504; 52/514; 292/346

[58] Field of Search ..... 49/460, 462, 504, 503; 52/514; 292/346; 70/416, 418

[56] References Cited

U.S. PATENT DOCUMENTS

| | | | |
|---|---|---|---|
| 2,127,891 | 8/1938 | Starling | 292/346 |
| 2,144,075 | 1/1939 | Mora | 292/346 |
| 3,401,487 | 9/1968 | Brandt et al. | 49/504 |
| 3,524,669 | 8/1970 | Reid | 292/346 |
| 3,673,605 | 6/1972 | Allenbaugh | 292/346 |
| 3,967,845 | 7/1976 | Governale | 292/346 X |
| 4,139,999 | 2/1979 | Allenbaugh | 70/452 |
| 4,281,480 | 8/1981 | Wendt | 49/504 |

OTHER PUBLICATIONS

"Install a Lock", brochure, M.A.G. Engineering and Manufacturing, Inc., Oct. 1979.

M.A.G. Engineering and Manufacturing, Inc., price list dated Jun., 1984.

Don-Jo Manufacturing, Inc., brochure, pp. 6,7 and 8.

*Primary Examiner*—Philip C. Kannan

*Attorney, Agent, or Firm*—Andrus, Sceales, Starke & Sawall

[57] ABSTRACT

A door jamb support includes an L-shaped reinforcing plate having a recessed portion with an opening therethrough positioned to be in alignment with a door latch on a door, a strike plate positionable within the recessed portion having an opening therethrough in alignment with the opening in the reinforcing support plate, an adjustment mechanism for adjusting the position of the strike plate on the support plate to vary the location of the strike plate opening with respect to the support plate opening, the fasteners for mounting the strike plate on the support plate. The adjustment mechanism includes a series of spaced projections on the strike plate above and below the strike plate opening and a corresponding series of spaced indentations on the support plate above and below the support plate opening. The adjustment feature enables the reinforcing support plate to accommodate variances in the design of and in the position of door handle latches in doors.

12 Claims, 5 Drawing Figures

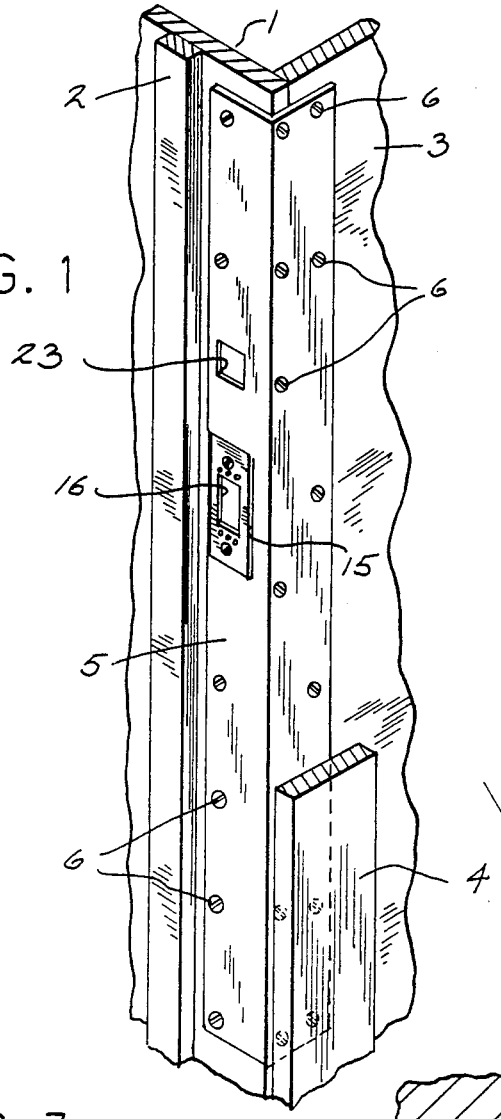
FIG. 1
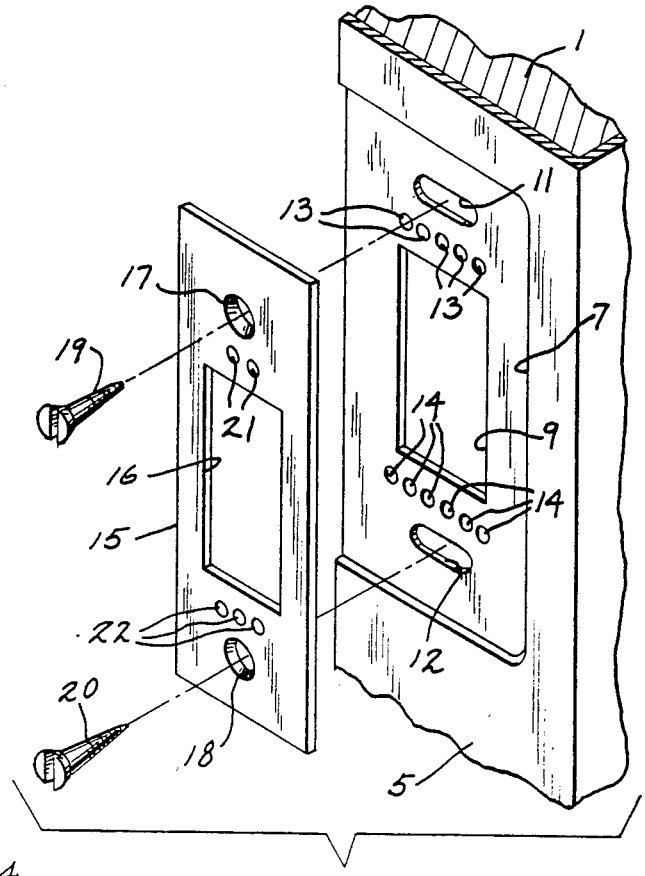
FIG. 2
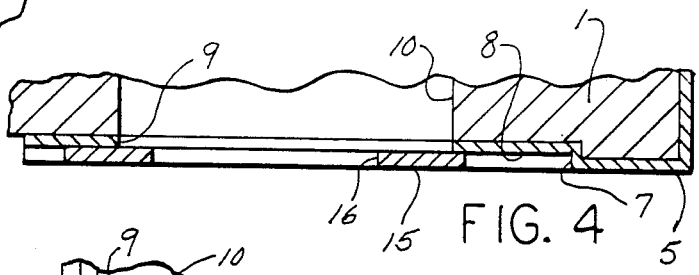
FIG. 4
FIG. 3
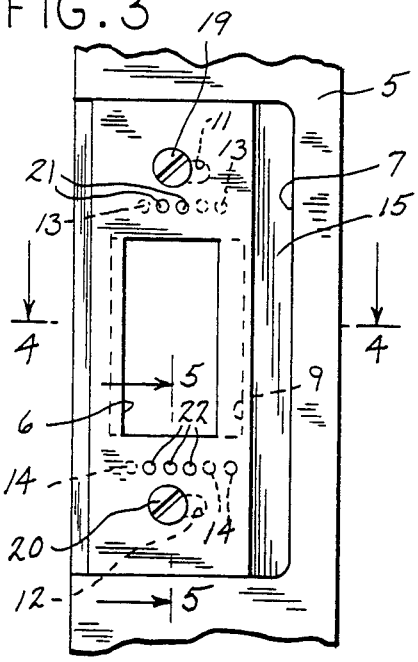
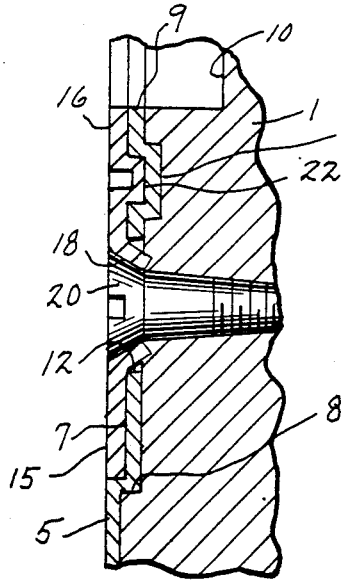
FIG. 5

DOOR JAMB SUPPORT

BACKGROUND OF THE INVENTION

The present invention relates to door frames, and more particularly to a support for a door jamb that not only reinforces the door jamb but also lends added security against forced entry.

A relatively easy manner of gaining entry through a door into a locked room, home or other establishment is to kick or pry the door until the wood of the door jamb splits. After the door jamb splits, the door may be easily forced open to gain entry.

Numerous types of security devices have been developed to aid in preventing forced entry, and to cover the damage caused on such burglarized doors and door frames. One such arrangement is shown in U.S. Pat. No. 4,139,999 which provides a U-shaped protective door shield which is positioned around the edge of a door in the region of the door knob and lock with its side panels overlying opposite sides of the door. Such a device, however, aids in protecting the door but not the door jamb. Devices for protecting the door jamb have typically been strike plates which include extralong screws for penetrating the door frame and the stud behind the wall adjacent the door frame. These latter devices, however, are inadequate for use with door frames that have previously been split or defaced.

SUMMARY OF THE INVENTION

A door jamb support includes reinforcing means mountable on a door jamb, a strike plate mounted on the reinforcing means, and adjustment means for adjusting the position of the strike plate to accommodate various types of door latches as well as minor variations in the positions of such door latches.

The reinforcing means includes an L-shaped support plate having a recessed portion that receives the strike plate so that the strike plate is substantially flush with the outer surface of the support plate when mounted therein. The recessed portion includes a rectangular opening formed therethrough which is positioned in alignment with the door latch on a door, and the strike plate includes a corresponding rectangular opening formed therethrough positionable in alignment with the opening in the support plate. The strike plate includes holes positioned above and below the strike plate opening, and the recessed portion of the support plate includes slots above and below the support plate opening which are in alignment with the holes in the strike plate so that fasteners may extend through the aligned holes and slots into the door jamb to secure the strike plate in place.

The adjustment means includes a series of spaced projections on the strike plate above and below the strike plate opening, and a corresponding series of spaced indentations on the support plate above and below the support plate opening. These projections and indentations enable the strike plate to be adjusted laterally in order to accommodate different types of door latches as well as minor variations in the positions of such door latches.

The present invention thus provides a door jamb support which not only reinforces the door jamb but also adds security against forced entry. The door jamb support further is designed to cover the damage on burglarized door frames such as jimmy marks, splits, and other defacements.

BRIEF DESCRIPTION OF THE DRAWINGS

The drawings illustrate the best mode presently contemplated of carrying out the invention.

In the drawings:

FIG. 1 is a fragmentary perspective view partially in section illustrating a door frame incorporating a door jamb support constructed in accordance with the principles of the present invention;

FIG. 2 is an enlarged fragmentary perspective view illustrating the manner of mounting the strike plate in the recessed portion of the support plate;

FIG. 3 is a fragmentary side view in elevation illustrating the strike plate mounted on the support plate;

FIG. 4 is a fragmentary cross-sectional view taken along the plane of the line 4—4 in FIG. 3; and FIG. 5 is a fragmentary cross-sectional view taken along the plane of the line 5—5 in FIG. 3.

DESCRIPTION OF THE PREFERRED EMBODIMENT

Referring now to the drawings, FIG. 1 illustrates a doorway incorporating a door jamb support constructed in accordance with the present invention. The doorway includes a jamb 1 with a door stop 2 secured thereon, and a wall 3 to which the door jamb 1 is nailed or otherwise secured. The doorway also includes a strip 4 of decorative molding or the like which surrounds the edge of jamb 1 and the ends of wall 3. Jamb 1, stop 2, wall 3 and molding 4 are typically composed of wood which may be easily split or otherwise damaged upon an attempt of forced entry from kicking or prying a door.

As a means for reinforcing door jamb 1, adding security to the doorway, and covering jimmy marks, splits or other defacements around old strike plates, the door jamb support includes an L-shaped flat reinforcing support plate 5 having one leg positionable in abutting relationship with the face of door jamb 1 and its other leg positioned in abutting relationship with the edge of jamb 1 and the face of the end of wall 3. Plate 5 is made of heavy gauge stainless steel or brass and includes a plurality of openings formed through each of its legs for receiving wood screws 6 that securely mount plate 5 to jamb 1 and wall 3. If desired, the screws extending through plate 5 into jamb 1 may be extra long, for example 3 inches, in order to penetrate both jamb 1 as well as a wall stud (not shown) located parallel to jamb 1 behind wall 3.

Plate 5 includes a rectangular shaped recessed portion 7 intermediate its length which is adapted to be received with a recess 8 formed in the face of jamb 1. Recessed portion 7 of plate 5 includes a rectangular shaped opening 9 formed therethrough which is disposed in alignment with an opening 10 formed in the face of door jamb 1 for receiving the latch (not shown) of a door knob assembly or similar device mounted along the edge of a door. Recessed portion 7 also includes a slot 11 located above opening 9 and a second slot 12 located below opening 9. The longitudinal dimension of slots 11 and 12 extend width wise within recessed portion 7. Recessed portion 7 also includes a series of five spaced indentations 13 located between upper slot 11 and opening 9, and a series of six spaced indentations 14 located between lower slot 12 and opening 9.

Plate 5 also includes a square opening 23 formed therethrough above recessed portion 7. Opening 23 receives the bolt (not shown) of a dead bolt lock or similar device mounted on a door.

The door jamb support also includes a rectangular shaped flat strike plate 15 dimensioned to be received within recessed portion 7. As shown best in FIG. 4, the depth of recessed portion 7 is such that when strike plate 15 is mounted on support plate 5 within recessed portion 7 its outer surface is substantially flush with the outer surface of support plate 5. Also, as shown best in FIG. 3, the longitudinal dimension of strike plate 15 is substantially the same as the longitudinal dimension of recessed portion 7 so that strike plate 15 closely fits within recessed portion 7. The width wide dimension of strike plate 15, however, is less than the width wise dimension of recessed portion 7 so that strike plate 15 may be adjusted laterally as will hereinafter be described. Strike plate 15 is also composed of heavy gauge stainless steel or brass.

Strike plate 15 includes a rectangular shaped opening 16 formed therethrough which is positioned in alignment with opening 9 and recessed portion 7 when strike plate 15 is mounted on support plate 5. As shown best in FIGS. 3 and 4, the longitudinal dimension of opening 16 is substantially identical to the longitudinal dimension of opening 9 in recessed portion 7 while the width wise dimension of opening 16 is less than the width dimension of opening 9. This permits the latch of a door knob assembly to pass through both openings 16 and 9 into opening 10 irregardless of the adjusted position of strike plate 15. Strike plate 15 also includes a counterbored hole 17 formed therethrough located above opening 16, and a second counter-bored hole 18 formed therethrough located below opening 16. Holes 17 and 18 are located in alignment with slots 11 and 12, respectively, in recessed portion 7 so that screws 19 and 20 may pass therethrough into jamb 1 and secure strike plate 15 in the desired position. Screws 19 and 20 may be extra long, for example three inches, so that they may pass through jamb 1 and into the stud (not shown) located behind wall 3.

As shown best in FIG. 5, strike plate 15 also includes two spaced projections 21 located between upper hole 17 and opening 16, and three spaced projections 22 located between lower hole 18 and opening 16. Projections 21 and 22 extend from the rear face of strike plate 15 and are adapted to be received within indentations 13 and 14 respectively. Projections 21 and 22 enable strike plate 15 to be adjusted to a plurality of lateral positions within recessed portion 7 of support plate 5 in order to accommodate various types of latches as well as to accommodate minor variations and the positions of these latches. It should also be noted that strike plate 15 could be rotated 180° from the positions shown in FIGS. 2 and 3 so that the three lower projections 22 would become the upper projections for engagement within indentations 13, and the two upper projections 21 would become the lower projections for engagement within the six lower indentations 14. This would enable small incremental lateral adjustments for strike plate 15 if such adjustment is desired or needed in order to accommodate a particular door latch. Thus, projections 21 and 22 together with indentations 13 and 14 provide an adjustment mechanism for adjusting the position of strike plate 15 on support plate 5 to vary the location of strike plate opening 16 with respect to support plate opening 9.

A door jamb support has been illustrated and described which includes a reinforcing support plate 5, a strike plate 15, an adjustment mechanism for adjusting the position of strike plate 15 on support plate 5 and means for mounting strike plate 15 on support plate 5. The door jamb support provides strength and reinforcement to protect new as well as old doorways, and also covers damage on burglarized doors such as jimmy marks, splits and other defacements.

Various modes of carrying out the invention are contemplated as being within the scope of the following claims particularly pointing and distinctly claiming the subject matter which is regarded as the invention.

I claim:

1. A door jamb support, comprising:

reinforcing means including a support plate having an opening therethrough and mountable on a door jamb so that said opening is in alignment with a door latch on a door;

a strike plate having an opening therethrough positionable in alignment with the opening in said support plate, said openings are rectangular in shape and the widthwise dimension of said strike plate opening is less than the widthwise dimension of said support plate opening;

adjustment means for adjusting the position of said strike plate on said support plate to vary the location of said strike plate opening with respect to said support plate opening, said adjustment means includes a series of spaced projections on said strike plate above and below said strike plate opening and a corresponding series of spaced indentations on said support plate above and below said support plate opening, and there are five indentations above said support plate opening and six indentations below said support plate opening, and there are two projections above said strike plate opening and three projections below said strike plate opening; and mounting means for mounting said strike plate on said support plate.

2. The door jamb support of claim 1, wherein said support plate is L-shaped.

3. The door jamb support of claim 1, wherein said support plate includes a recessed portion that receives said strike plate so that said strike plate is substantially flush with said support plate when mounted thereon, and said support plate opening is located in said recessed portion.

4. The door jamb support of claim 1, wherein said mounting means includes a first slot above said support plate opening and a second slot below said support plate opening, a first hole above said strike plate opening and a second hole below said strike plate opening in alignment with said slots, and fastener means extending through said aligned holes and slots into said door jamb.

5. The door jamb support of claim 4, wherein said indentations are located between said support plate opening and said slots, and said projections are located between said strike plate opening and said holes.

6. A door jamb support for jamb support for permitting reutilization of a damaged door jamb, said door jamb including a first face disposed opposite the edge of a door when closed and a second face extending laterally from said first face and disposed opposite a strip of molding on one side of said door jamb, comprising:

reinforcing means including an elongated L-shaped support plate having a first plate member with an opening therethrough and mountable on the first face of said door jamb so that said opening is in alignment with a door latch on a door, and a second plate member formed integral with and coextensive with said first plate member extending laterally from said first plate member at a right angle thereto, said second plate member mountable on the second face of said door jamb between said molding strip and said one side of said door jamb, said first and second plate members having a length greater than the longitudinal extent of the damage to said door jamb;

a strike plate having an opening therethrough positionable in alignment with the opening in said support plate;

adjustment means for adjusting the position of said strike plate on said support plate to vary the location of said strike plate opening with respect to said support plate opening; and mounting means for mounting said strike plate on said support plate.

7. The door jamb support of claim 6, wherein said support plate includes a recessed portion that receives said strike plate so that said strike plate is substantially flush with said support plate when mounted thereon, and said support plate opening is located in said recessed portion.

8. The door jamb support of claim 6, wherein said openings are rectangular in shape and the widthwise dimension of said strike plate opening is less than the widthwise dimension of said support plate opening.

9. The door jamb support of claim 8, wherein said adjustment means includes a series of spaced projections on said strike plate above and below said strike plate opening and a corresponding series of spaced indentations on said support plate above and below said support plate opening.

10. The door jamb support of claim 9, wherein there are five indentations above said support plate opening and six indentations below said support plate opening, and there are two projections above said strike plate opening and three projections below said strike plate opening.

11. The door jamb support of claim 9, wherein said mounting means includes a first slot above said support plate opening and a second slot below said support plate opening, a first hole above said strike plate opening and a second hole below said strike plate opening in alignment with said slots, and fastener means extending through said aligned holes and slots into said door jamb.

12. The door jamb support of claim 11, wherein said indentations are located between said support plate opening and said slots, and said projections are located between said strike plate opening and said holes.

* * * * *